US007914116B2

(12) United States Patent
Suzuki

(10) Patent No.: US 7,914,116 B2
(45) Date of Patent: Mar. 29, 2011

(54) DROPLET DISCHARGE HEAD, MANUFACTURING METHOD THEREOF, AND DROPLET DISCHARGE APPARATUS

(75) Inventor: Katsumi Suzuki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 416 days.

(21) Appl. No.: 12/207,108

(22) Filed: Sep. 9, 2008

(65) Prior Publication Data

US 2009/0115817 A1 May 7, 2009

(30) Foreign Application Priority Data

Nov. 5, 2007 (JP) ..... 2007-287011

(51) Int. Cl.
*B41J 2/135* (2006.01)

(52) U.S. Cl. ..... 347/45; 347/64; 347/71

(58) Field of Classification Search ..... 347/40, 347/45–47, 64, 67, 71, 86–87
See application file for complete search history.

(56) References Cited

U.S. PATENT DOCUMENTS 6,447,984 B1 * 9/2002 Tatsumi et al. ..... 430/320
7,267,426 B2 9/2007 Miyajima et al.

FOREIGN PATENT DOCUMENTS

| | | | |
|---|---|---|---|
| CN | 2740401 | Y | 11/2005 |
| JP | 06-305141 | A | 11/1994 |
| JP | H07-223316 | A | 8/1995 |
| JP | 2003-276192 | A | 9/2003 |
| JP | 2004-17415 | A | 1/2004 |
| JP | 2007-253433 | A | 10/2007 |

* cited by examiner

*Primary Examiner* — Thinh H Nguyen
(74) *Attorney, Agent, or Firm* — Global IP Counselors, LLP

(57) ABSTRACT

A droplet discharge head includes a nozzle substrate having a nozzle opening for discharging a liquid as a droplet; a flow path substrate having a flow path for the liquid, the flow path communicating with the nozzle opening; and a diaphragm constituting a wall surface of the flow path. The nozzle substrate, the flow path substrate, and the diaphragm are bonded together in layers using an adhesive, and a liquid-resistant film resistant to the liquid is continuously formed on surfaces of the nozzle substrate, the flow path substrate, and the diaphragm, the surfaces being in contact with the liquid.

10 Claims, 5 Drawing Sheets

DROPLET DISCHARGE HEAD, MANUFACTURING METHOD THEREOF, AND DROPLET DISCHARGE APPARATUS

BACKGROUND

1. Technical Field

The present invention relates to a droplet discharge head, a manufacturing method thereof, and a droplet discharge apparatus.

2. Related Art

There has been known an inkjet head formed by boding a nozzle plate to the top surface of a head body using an adhesive such as an epoxy resin (for example, see JP-A-07-223316). Also, there has been disclosed an inkjet recording apparatus in which an oxide film or a titanium nitride film is formed as a liquid-resistant thin film (ink-resistant thin film) on the wall surface of a liquid flow path with a silicon substrate used as a liquid chamber forming member so as to prevent eluted silicon from blending into the ink as well as so as to prevent warpage from occurring in the entire liquid chamber forming member due to internal stress of the liquid-resistant thin film (for example, see JP-A-2003-276192).

In the above-described related-art droplet discharge apparatuses, an adhesive such as an epoxy adhesive or an acrylic adhesive is used to bond the nozzle plate, liquid chamber forming member, and the like to the droplet discharge head. Therefore, when the droplet discharge head is filled with a discharge liquid such as solution ink such as N-methyl-2-pyrrolidone (NMP), butyl cellosolve, or y-butyrolactone, or alkali ink or when the discharge liquid is discharged from the droplet discharge head, the discharge liquid penetrates the bonding sections so that the adhesive swells. This reduces the durability of the droplet discharge head and therefore reduces the life thereof. Thus, the droplet discharge head must be replaced frequently. Also, in order to prevent the discharge liquid from being contaminated due to the solution of the adhesive, the types of the solvent for the discharge liquid are limited.

SUMMARY

An advantage of the invention is to provide a droplet discharge head, a manufacturing method thereof, and a droplet discharge apparatus for preventing penetration of a discharge liquid into a bonding section so that the durability of the droplet discharge head is improved and so that the types of the discharge liquid are not limited.

According to a first aspect of the invention, a droplet discharge head includes a nozzle substrate having a nozzle opening for discharging a liquid as a droplet; a flow path substrate having a flow path for the liquid, the flow path communicating with the nozzle opening; and a diaphragm constituting a wall surface of the flow path. The nozzle substrate, the flow path substrate, and the diaphragm are bonded together in layers using an adhesive, and a liquid-resistant film resistant to the liquid is continuously formed on surfaces of the nozzle substrate, the flow path substrate, and the diaphragm, the surfaces being in contact with the liquid.

According to this configuration, the bonding section between the nozzle substrate and flow path substrate and the bonding section between the flow path substrate and diaphragm are covered with the continuing liquid-resistant film in the flow path for the liquid so that the liquid in the flow path does not make contact with the bonding sections. This prevents the liquid in the flow path from penetrating gaps in the bonding sections or prevents the liquid from making contact with the adhesive exposed on the portions of the bonding sections facing the flow path. This prevents the liquid from penetrating the adhesive to cause the adhesive to swell. Thus, the durability of the droplet discharge head is improved. Also, since the adhesive is isolated from the liquid, the liquid is prevented from being contaminated due to the solution of the adhesive and the types of a dischargeable liquid are not limited by the material of the adhesive.

The droplet discharge head according to the first aspect of the invention preferably further includes: a piezoelectric element for changing, via the diaphragm, a volume of a pressure chamber provided in the flow path; and a casing holding the piezoelectric element and having a liquid supply path for supplying the liquid to the flow path. The casing is preferably bonded to the diaphragm using an adhesive, and a surface of the casing facing the liquid supply path is preferably covered with the liquid-resistant film continuously formed from the surface of the diaphragm in contact with the liquid.

According to this configuration, the bonding section between the casing and diaphragm is covered with the liquid-resistant film in the flow supply path so that the liquid in the flow path does not make contact with the bonding section. This prevents the liquid in the flow supply path from penetrating a gap in the bonding section or prevents the liquid from making contact with the adhesive exposed on the portion of the bonding section facing the flow path. This prevents the liquid from penetrating the bonding section to cause the adhesive to swell. Thus, the durability of the droplet discharge head is improved. Also, since the adhesive is isolated from the liquid, the liquid is prevented from being contaminated due to the solution of the adhesive and the types of a dischargeable liquid are not limited by the material of the adhesive.

In the droplet discharge head according to the first aspect of the invention, the liquid-resistant film is preferably formed of a lyophilic material.

According to this configuration, the wettability of internal portions of the droplet discharge head facing the liquid is improved so that the menisci of droplets of the liquid are arranged when the droplets are discharged from the nozzles. Thus, the droplet discharge performance is improved.

In the droplet discharge head according to the first aspect of the invention, the liquid-resistant film is preferably formed of a liquid-repellent material.

According to this configuration, the characteristic of the liquid-resistant film for isolating the liquid from the bonding section is improved so that the thickness of the liquid-resistant film is reduced.

In the droplet discharge head according to the first aspect of the invention, a thickness of the liquid-resistant film is preferably equal to or larger than a thickness of one molecule layer and equal to or less than 1 μm.

According to this configuration, the characteristic of the liquid-resistant film for isolating the liquid from the bonding section is sufficiently exhibited. Also, the liquid-resistant film is prevented from affecting the discharge of the liquid.

According to a second aspect of the invention, a method for manufacturing a droplet discharge head includes: (a) bonding together a nozzle substrate, a flow path substrate, and a diaphragm in layers using an adhesive, the nozzle substrate having a nozzle opening for discharging a liquid as a droplet, the flow path substrate having a flow path for the liquid, the flow path communicating with the nozzle opening, the diaphragm constituting a wall surface of the flow path; (b) filling the flow path with a material liquid for a liquid-resistant film; and (c) discharging the material liquid from the flow path and heating and then drying the material liquid adhering to surfaces of the nozzle substrate, the flow path substrate, and the diaphragm so that a liquid-resistant film resistant to the liquid-is continuously formed on the surfaces, the surfaces being in contact with the liquid.

According to this manufacturing method, the bonding section between the nozzle substrate and flow path substrate and the bonding between the flow path substrate and diaphragm are covered with the continuing liquid-resistant film. Thus, even if the flow path is filled with the liquid when droplets are discharged, the liquid in the flow path does not make contact with the bonding sections. This prevents the liquid in the flow path from penetrating gaps in the bonding sections or prevents the liquid from making contact with the adhesive exposed on the portions of the bonding sections facing the flow path. This prevents the liquid from penetrating the adhesive to cause the adhesive to swell. Thus, the durability of the droplet discharge head is improved. Also, since the adhesive is isolated from the liquid, the liquid is prevented from being contaminated due to the solution of the adhesive and the types of a dischargeable liquid are not limited by the material of the adhesive.

In the method for manufacturing a droplet discharge head according to the second aspect of the invention, in step (a), a casing holding a piezoelectric element and having a liquid supply path for supplying the liquid to the flow path is preferably bonded to the diaphragm using an adhesive, the piezoelectric element changing, via the diaphragm, a volume of a pressure chamber provided in the flow path. In step (b), the flow path and the liquid supply path are preferably filled with the material liquid. In step (c), the material liquid adhering to a surface of the casing facing the liquid supply path is preferably heated and then dried so that the liquid-resistant film continuing from a surface of the diaphragm facing the flow path to the surface of the casing facing the liquid supply path is formed.

According to this manufacturing method, the bonding section between the casing and diaphragm is covered with the liquid-resistant film. Thus, even if the flow path is filled with the liquid when droplets are discharged, the liquid in the flow path does not make contact with the bonding section. This prevents the liquid in the flow path from penetrating a gap in the bonding section or prevents the liquid from making contact with the adhesive exposed on the portion of the bonding section facing the flow path. This prevents the liquid from penetrating the bonding section to cause the adhesive to swell. Thus, the durability of the droplet discharge head is improved. Also, since the adhesive is isolated from the liquid, the liquid is prevented from being contaminated due to the solution of the adhesive and the types of a discharge liquid are not limited by the material of the adhesive.

In the method for manufacturing a droplet discharge head according to the second aspect of the invention, in step (b), the material liquid is preferably a material liquid containing Si.

According to this manufacturing method, the liquid-resistant film formed in step (c) becomes, for example, a lyophilic, liquid-resistant film such as $SiO_x$. Thus, the wettability of internal portions of the droplet discharge head facing the liquid is improved so that the menisci of droplets of the liquid are arranged when the droplets are discharged from the nozzles. As a result, the droplet discharge performance is improved.

In the method for manufacturing a droplet discharge head according to the second aspect of the invention, in step (b), the material liquid is preferably any one of a fluoro material liquid, a silicone material liquid, and an organopolysiloxane material liquid containing fluorine.

According to this manufacturing method, the liquid-resistant film formed in step (c) becomes, for example, a liquid-repellent, liquid-resistant film. Thus, the characteristic of the liquid-resistant film for isolating the liquid from the bonding section is improved so that the liquid-resistant film is thinned.

A droplet discharge apparatus according to a third aspect of the invention includes the droplet discharge head according to the first aspect of the invention.

Thus, the droplet discharge apparatus is provided that prevents the discharge liquid from penetrating the bonding sections of the droplet discharge head, improves the durability of the droplet discharge head, and does not limit the types of the discharge liquid.

BRIEF DESCRIPTION OF THE DRAWINGS

The invention will be described with reference to the accompanying drawings, wherein like reference numerals designate like elements.

DESCRIPTION OF EXEMPLARY EMBODIMENTS

Now, an embodiment of the invention will be described with reference to the accompanying drawings.

Figure 1:
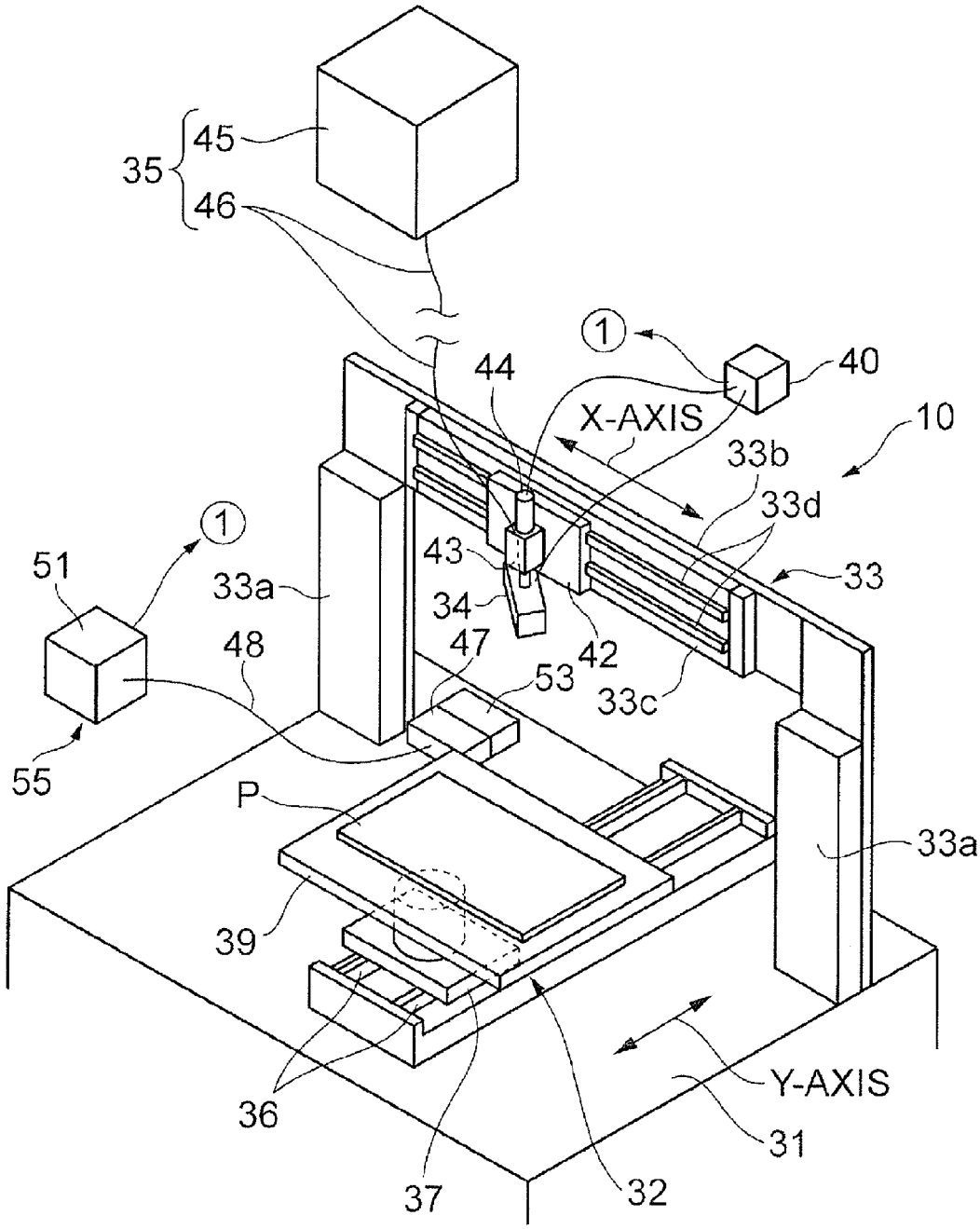
FIG. 1 is a schematic view showing an overall configuration of a droplet discharge apparatus according to an embodiment of the invention.

FIG. 1 is a schematic view showing an outline configuration of a droplet discharge apparatus 10. As shown in FIG. 1, the droplet discharge apparatus (liquid spray apparatus) 10 includes a base 31, a substrate carrier 32, a head carrier 33, a droplet discharge head 34, an ink supply unit 35, and a controller 40. The substrate carrier 32 and head carrier 33 are provided on the base 31.

The droplet discharge apparatus 10 also includes a cleaning unit 53 and a capping unit 55.

The substrate carrier 32 includes guide rails 36 disposed on the base 31 along the Y-axis. The substrate carrier 32 moves a slider 37 along the guide rails 36, for example, using a linear motor (now shown).

A stage 39 for positioning and holding the substrate P is fixed to the slider 37. That is, the stage 39 includes a publicly known absorption holder (not shown) and holds the substrate P on the stage 39 in an absorptive manner by operating the absorption holder. The substrate P is positioned accurately in a predetermined position on the state 39, for example, using a positioning pin (not shown) of the stage 39 and is held there.

The head carrier 33 includes a pair of stands 33*a* set up on a rear portion of the base 31 and a track 33*b* provided on the stands 33*a*. In the head carrier 33, the track 33*b* is disposed along the X axis direction, that is, along a direction orthogonal to the Y axis direction, along which the guide rails of the substrate carrier 32 are disposed. The track 33*b* includes a holding plate 33*c* provided between the stands 33*a* and a pair of guide rails 33*d* provided on the holding plate 33*c*. The track 33*b* holds a carriage 42 provided with the droplet discharge head 34 in such a manner that the carriage 42 is movable in the length direction of the guide rails 33*d*. The carriage 42 travels on the guide rails 33*d* according to the operation of a linear motor (not shown) and the like so that the droplet discharge head 34 moves in the X axis direction.

The carriage 42 is configured so that it is movable, for example, in units of 1 μm in the length direction of the guide rails 33*d*, that is, in the X axis direction. Such movement of the carriage 42 is controlled by the controller 40 including a computer and the like.

The controller 40 detects and stores information about the positions of the droplet discharge head 34, that is, the positions (X coordinates) of the droplet discharge head 34 on the guide rails 33*d* and the positions (X coordinates) of the nozzles at that time The droplet discharge head 34 is mounted on the carriage 42 with a mounting unit 43 therebetween in such a manner that it is rotatable. The mounting unit 43 is provided with a motor 44, to which a supporting axis (not shown) of the droplet discharge head 34 is connected. According to this configuration, the droplet discharge head 34 is rotatable in the circumference direction thereof. The motor is also coupled to the controller 40 so that the rotation of the droplet discharge head 34 in the circumference direction thereof is controlled by the controller 40.

The ink supply unit 35 includes an ink tank 45 that is filled with ink L and an ink supply tube 46 for sending the ink L from the ink tank 45 to the droplet discharge head 34.

The cleaning unit 53 is allowed to clean such as the nozzles of the droplet discharge head 34 when the substrate P is being manufactured, or periodically or as necessary when the droplet discharge head 34 is on standby. Note that when the ink L is discharged onto the substrate P, the cleaning unit 53 is held in a position where the cleaning unit 53 does not interfere with the operation of the droplet discharge head 34.

The capping unit 55 includes a cap 47, a liquid suction tube 48, and a suction pump 51 connected to the liquid suction tube 48. In order to prevent a nozzle opening surface 143*a* (see FIG. 3) of the droplet discharge head 34 from being dried, the capping unit 55 covers the nozzle opening surface 143*a* with the cap 47 when the droplet discharge head 34 is discharging the ink L onto the substrate P or is on standby.

Also, the capping unit 55 has a function of initially filling the droplet discharge head 34 with the ink L. When the capping unit 55 performs the initial filling, it also covers the nozzle opening surface 143*a* with the cap 47.

Figure 4:
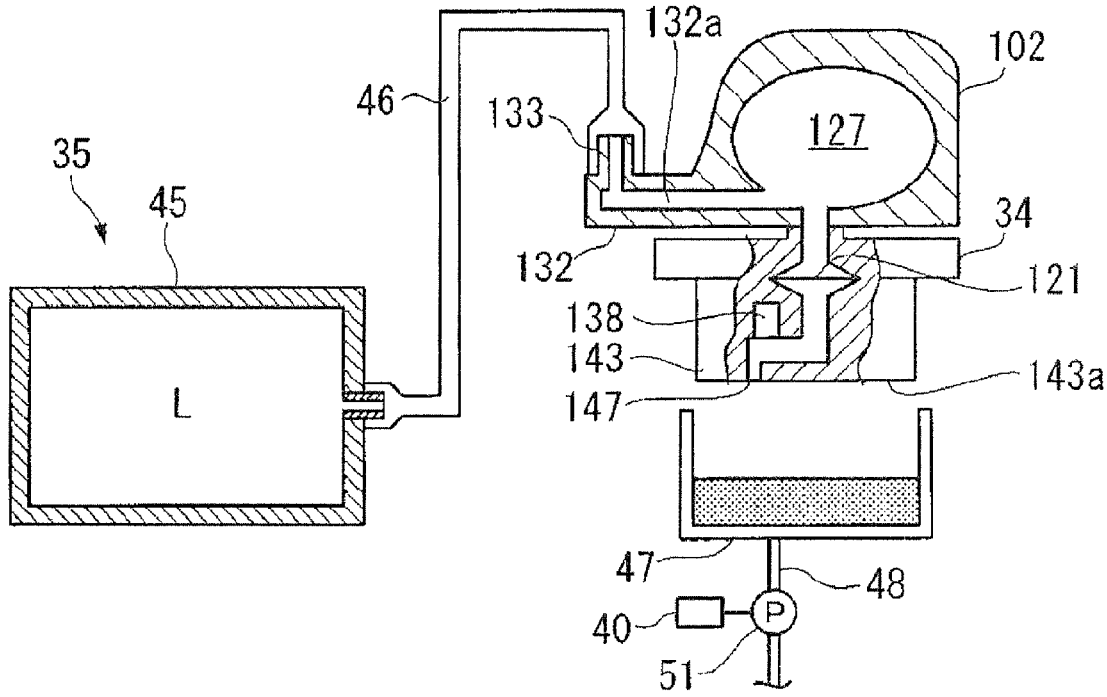
FIG. 4 is a schematic view showing an outline configuration of the droplet discharge apparatus according to the embodiment of the invention.

The cap 47 moves vertically along a guide (not shown) or the like provided in the droplet discharge head 34 so that it abuts on and adhere to the nozzle opening surface 143*a* of the droplet discharge head 34 (see FIG. 4). The cap 47 is made of silicone, fluoroplastics, or the like and is coupled to the suction pump 51 for sucking the ink L, via the liquid suction tube 48.

The suction pump 51 is provided with a control mechanism (not shown) including such as a pressure control valve for controlling the degree of pressure reduction for sucking the ink L. The pressure control valve is coupled to the controller 40 so that the increase or reduction of pressure is controlled. When the ink L is discharged onto the substrate P, the capping unit 55 is held in a position where the capping unit 55 does not interfere with the operation of the droplet discharge head 34.

Figure 2:
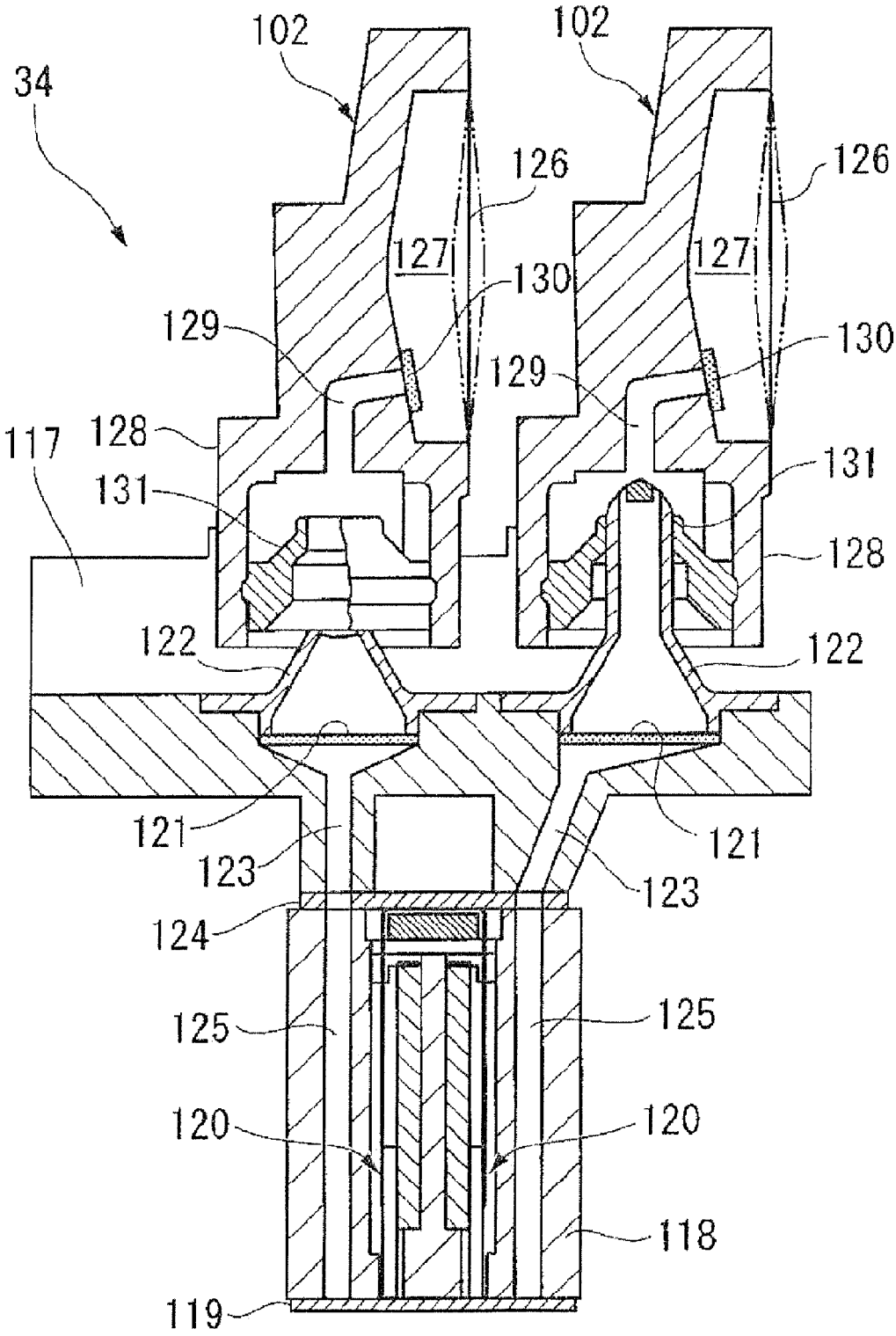
FIG. 2 is a sectional view showing a configuration of a droplet discharge head according to this embodiment.
Figure 3:
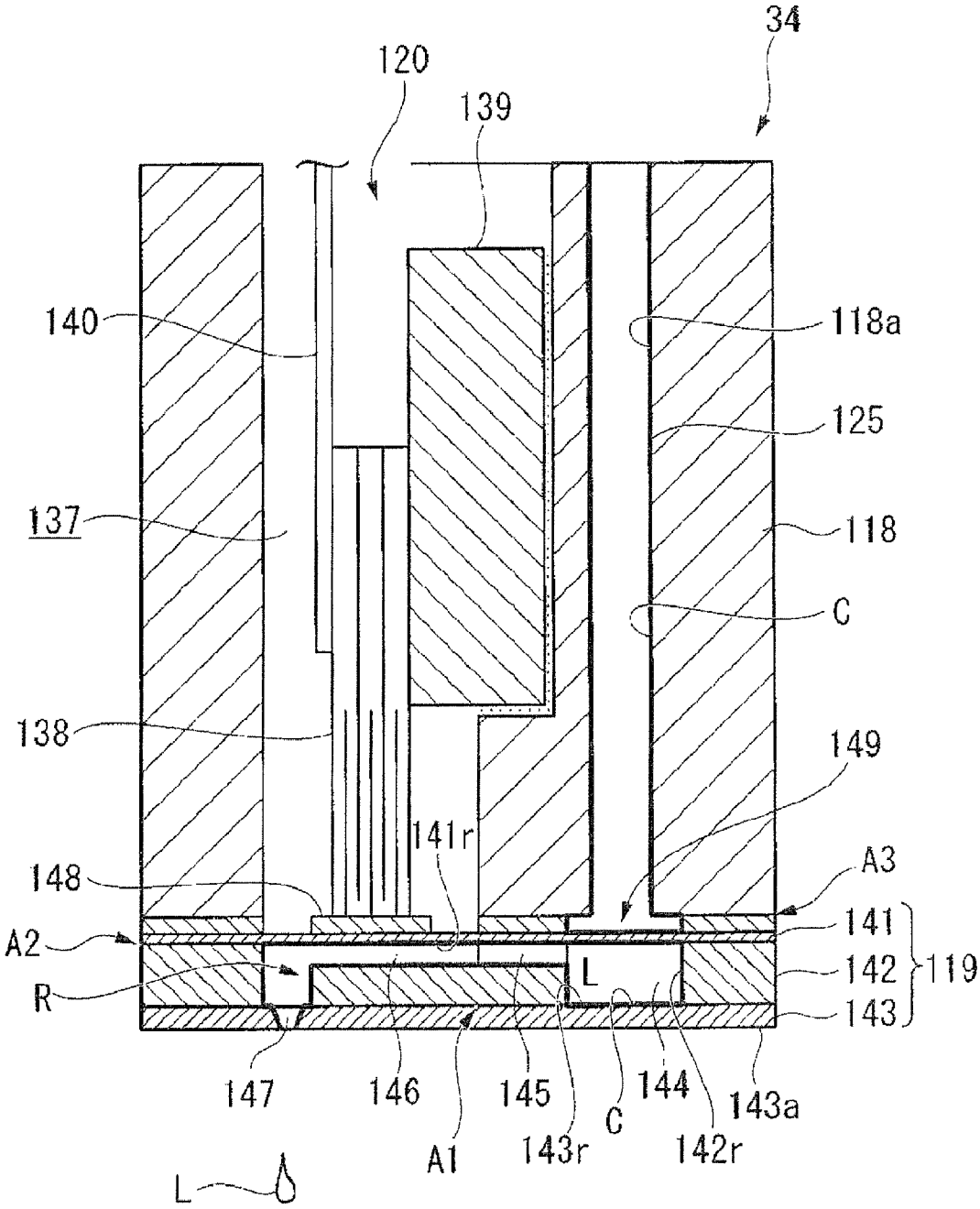
FIG. 3 is a sectional view of a main part of the droplet discharge head according to this embodiment.

FIG. 2 is a sectional view showing a configuration of the droplet discharge head 34. FIG. 3 is a sectional view of a main part of the droplet discharge head 34.

The droplet discharge head 34 according to this embodiment mainly includes an introducer needle unit 117, a head case 118 (casing), a flow path unit 119, and an actuator unit 120.

Two ink introducer needles 122 are mounted on the upper surface of the introducer needle unit 117 side-by-side with filters 121 therebetween. The ink introducer needles 122 are loaded with sub-tanks 102. The introducer needle unit 117 has ink introduction paths 123 corresponding to the ink introducer needles 122.

The upper ends of the ink introduction paths 123 communicate with the ink introducer needles 122 via the filters 121. The lower ends thereof communicate with case flow paths 125 (liquid supply paths) formed in the head case 118 via packing 128.

The filters 121 are provided to eliminate foreign matters included in the ink L. The filters 121 are formed of, e.g., stainless steel and in the form of meshes.

The sub-tanks 102 are formed of a resin material such as polypropylene. The sub-tanks 102 have recesses serving as the ink chambers 127. The ink chambers 127 are defined by attaching elastic sheets 126 to the opening surfaces of the recesses.

Needle connectors 128 into which the ink introducer needles 122 are inserted are provided below the sub-tanks 102 in a downwardly extending manner. The ink chambers 127 in the sub-tanks 102 each take the shape of a shallow mortar. The upstream openings of the connection flow paths 129 communicating with the needle connectors 128 face positions slightly below the centers in the vertical direction on sides of the ink chambers 127. Tank filters 130 for filtering the ink L are attached to the upstream openings.

Sealing members 131 into which the ink introducer needles 122 are inserted are packed fluid-tight in the internal spaces of the needle connectors 128. As shown in FIG. 4, an extending unit 127 having a communication groove 132*a* communicating with the ink chamber 127 is formed in the sub-tank 102. An ink inlet 133 is provided in a protruding manner on the upper surface of the extending unit 132.

The ink supply tube 46 for supplying the ink L stored in the ink tank 45 of the ink supply unit 35 is connected to the ink inlet 133. Thus, the ink L passing through the ink supply tube 46 flows into the ink chamber 127 via the ink inlet 133 and communication groove 132*a*.

The above-described elastic sheets 126 are deformable in the direction in which the ink chambers 127 shrink and in the direction in which the ink chambers 127 swell. A damper function obtained due to the deformation of the elastic sheets 126 absorbs variations in pressure of the ink L. That is, due to the operation of the elastic sheets 126, the sub-tanks 102 serve as pressure dampers. Thus, the ink L is supplied to the droplet discharge head 34 with pressure variations absorbed in the sub-tanks 102.

The head case 118 is a hollow box-shaped member made of a synthetic resin. The flow path unit 119 is bonded to the lower surface of the head case 118 using an adhesive. Actuator units 120 are contained in containing spaces 137 internally formed in the head case 118. The introducer needle unit 117 is mounted on the upper surface of the head case 118 opposed to the flow path unit 119 with the packing 124 therebetween.

The head case 118 has case flow paths 125 passing through in the height direction. The upper ends of the case flow paths 125 communicate with the ink introduction paths 123 of the introducer needle unit 117 via the packing 124.

The lower ends of the case flow paths 125 communicate with a common ink chamber 144 in the flow path unit 119. Thus, the ink L introduced by the ink introducer needles 122 is supplied to the common ink chamber 144 via the ink introduction paths 123 and case flow paths 125.

As shown in FIG. 3, the actuator unit 120 contained in the containing space 137 of the head case 118 includes multiple piezoelectric vibrators 138 provided in rows in the form of comb-teeth, a fixing plate 139 to which the piezoelectric vibrators 138 are bonded, and a flexible cable 140 that is a wiring member for providing drive signals from the controller 40 to the piezoelectric vibrators 138. The fixed end of each piezoelectric vibrator 138 is bonded to the fixing plate 139 and the free end thereof protrudes from the top surface of the fixing plate 139. That is, each piezoelectric vibrator 138 is mounted on the fixing plate in a so-called "cantilever" manner.

The fixing plate 139 supporting the piezoelectric vibrators 138 is made of, e.g., stainless steel with a thickness of approximately 1 mm. The actuator unit 120 is contained and fixed in the containing space 137 by attaching the back of the fixing plate 139 to a wall surface defining the containing space 137 in the head case 118.

The flow path unit 119 is manufactured by bonding together flow path unit members, that is, a diaphragm 141, a flow path substrate 142, and a nozzle substrate 143 in layers using an adhesive to integrate these members. These flow path unit members are members for forming a string of ink flow path R from the common ink chamber 144 through the ink inlet 145 and a pressure chamber 146 to the nozzles 147.

The pressure chamber 146 is formed as a chamber elongated in a direction orthogonal to the direction in which the nozzles 147 are arranged in rows (nozzle row direction).

The common ink chamber 144 is a chamber that communicates with the case flow path 125 and receives the ink L from the ink introducer needle 122. The ink L received by the common ink chamber 144 is distributed to the pressure chambers 146 via the ink inlet 145.

In this embodiment, a liquid-resistant film C that is resistant to the ink L is continuously formed on a surface 143*r*, a surface 142*r*, and a surface 141*r* of the nozzle substrate 143, flow path substrate 142, and diaphragm 141, respectively, each facing the ink flow path R, which are surfaces of these members in contact with the ink L. Also, a surface 118*a* of the head case 118 facing the case flow path 125 is covered with the liquid-resistant film C formed continuously from the surface 141*r* of the diaphragm 141 facing the ink flow path R.

The liquid-resistant film C is a lyophilic film formed of an Si oxide such as $SiO_2$. The liquid-resistant film C is formed with a thickness equal to or larger than the thickness of one molecule layer and equal to or less than 1 μm.

The nozzle substrate 143 disposed on the bottom of the flow path unit 119 is a thin metal plate material in which the multiple nozzles 147 are provided in rows in an open manner at a pitch (e.g., 180 dpi) corresponding to the dot formation density. The nozzle substrate 143 according to this embodiment is formed of a plate material made of stainless steel. In this embodiment, a total of 22 rows of the nozzles 147 (that is, nozzle rows) are provided in parallel so as to correspond to each sub-tank 102. One nozzle row includes, for example, 180 units of nozzles 147.

The flow path substrate 142 disposed between the nozzle substrate 143 and diaphragm 141 is a plate-shaped member in which ink flow paths, specifically, spaces serving as the common ink chamber 144, ink inlet 145, and pressure chamber 146 are defined and formed.

In this embodiment, the flow path substrate 142 is manufactured by subjecting a Si wafer as a crystalline substrate to anisotropic etching. The diaphragm 141 is a double-structured composite plate member manufactured by forming elastic films in layers on a metal supporting plate made of stainless steel or the like. An island 148 to which the top surface of the piezoelectric vibrator 138 is bonded is formed in a part of the diaphragm 141 corresponding to the pressure chamber 146 by eliminating a part of the supporting plate in the form of a ring by etching or the like. This island serves as a diaphragm unit. That is, the diaphragm 141 elastically deforms an elastic film around the island 148 according to the operation of the piezoelectric vibrator 138. The diaphragm 141 also serves as a compliance unit 149 for sealing one opening surface of the flow path substrate 142. Like the diaphragm unit, a part corresponding to the compliance unit 149 is an elastic film left by eliminating the supporting plate by etching or the like.

If a drive signal is provided to one of the piezoelectric vibrators 138 via the flexible cable 140 in the droplet discharge head 34, the piezoelectric vibrator 138 shrinks or swells in the longitudinal direction thereof. Accordingly, the island 148 moves in the direction in which the island 148 comes close to the pressure chamber 146 or in the direction in which the island 148 goes away therefrom. Thus, the volume of the pressure chamber 146 is changed so that a variation occurs in pressure of the ink L in the pressure chamber 146. Due to this pressure variation, the ink L is discharged as droplets from the nozzles 147.

The ink L used in this embodiment is, for example, solvent ink such as N-methyl-2-pyrrolidone (NMP), butyl cellosolve, or y-butyrolactone, or alkali ink.

Next, the operation of this embodiment will be described.

As shown in FIG. 3, a portion of a bonding section A1 between the nozzle substrate 143 and flow path substrate 142 facing the ink flow path R and a portion of a bonding section A2 between the flow path substrate 142 and diaphragm 141 facing the ink flow path R are covered with the continuously formed liquid-resistant film C. Thus, the ink L is blocked by the liquid-resistant film C so that the ink L does not make contact with the bonding sections A1 and A2. This prevents the ink L in the ink flow path R from penetrating gaps in the bonding sections A1 and A2 or prevents the ink from making contact with the adhesive exposed on portions of the bonding sections A1 and A2 facing the ink flow path R. This prevents the ink L from penetrating the adhesive on the portions of the bonding sections A1 and A2 to cause the adhesive to swell. This prevents the flow path substrate 142, diaphragm 141, and nozzle substrate 143 from being peeled away from each other. As a result, the durability of the flow path unit 119 and, therefore, that of the droplet discharge head 34 is improved.

Also, a part of a bonding section A3 between the heads case 118 and diaphragm 141 is covered with the liquid-resistant film C so that the ink L in the case flow path 125 does not make contact with the bonding section A3. This prevents the ink L in the case flow path 125 from penetrating a gap in the bonding section A3 or prevents the ink L from making contact with the adhesive exposed on a portion of the bonding section A3 facing the case flow path 125. This prevents the ink L from penetrating the bonding section A3 to cause the adhesive to swell. Thus, the head case 118 and flow path unit 119 are prevented from being peeled away from each other. As a result, the durability of the droplet discharge head 34 is improved.

Also, the bonding sections A1, A2, and A3 are isolated from the ink L by the liquid-resistant film C so that the adhesive used in the bonding sections A1, A2, and A3 is prevented from making contact with the ink L. Thus, the ink L is prevented from being contaminated due to the solution of the adhesive. Therefore, the types of the ink L to be discharged are not limited by the material of the adhesive.

Also, the liquid-resistant film C is made of a lyophilic material such as $SiO_2$; therefore, the wettability of parts of the ink flow path R in contact with the ink L in the droplet discharge head 34 is improved. Thus, when the ink L is discharged as droplets from the nozzles 147, the menisci of droplets are arranged. As a result, droplets of the ink L are discharged with improved performance.

Also, if the liquid-resistant film C is formed with a thickness equal to or larger than the thickness of one molecule layer and equal to or less than 1μ, the liquid-resistant film C sufficiently exhibits a liquid-resistant characteristic and an isolation characteristic with respect to the ink L. Also, the thickness of the liquid-resistant film C is sufficiently small; therefore, the film is prevented from affecting the discharge of the ink L.

As described above, according to the droplet discharge head 34 according to this embodiment, penetration of the ink L into the bonding sections A1, A2, and A3 is prevented. Thus, the durability of the droplet discharge head 34 is improved and the types of the ink L are not limited by the material of the adhesive. Also, the droplet discharge apparatus 10 according to this embodiment includes the droplet discharge head 34; therefore, penetration of the ink L into the bonding sections A1, A2, and A3 in the droplet discharge head 34 is prevented. Thus, the durability of the droplet discharge head 34 is improved and the types of the ink L are not limited by the material of the adhesive.

Method for Manufacturing Droplet Discharge Head

Figure 5A:
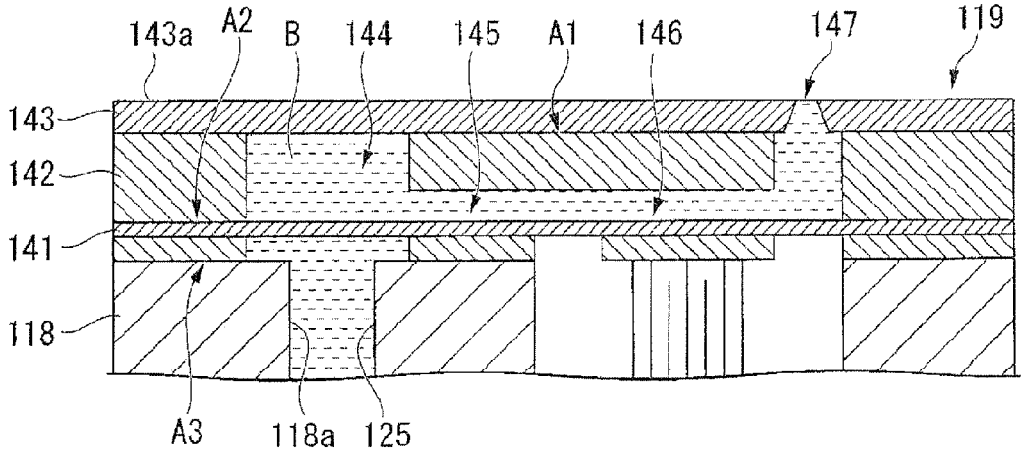
FIGS. 5A to 5C are enlarged sectional views showing a process of manufacturing the droplet discharge head according to this embodiment.
Figure 5B:
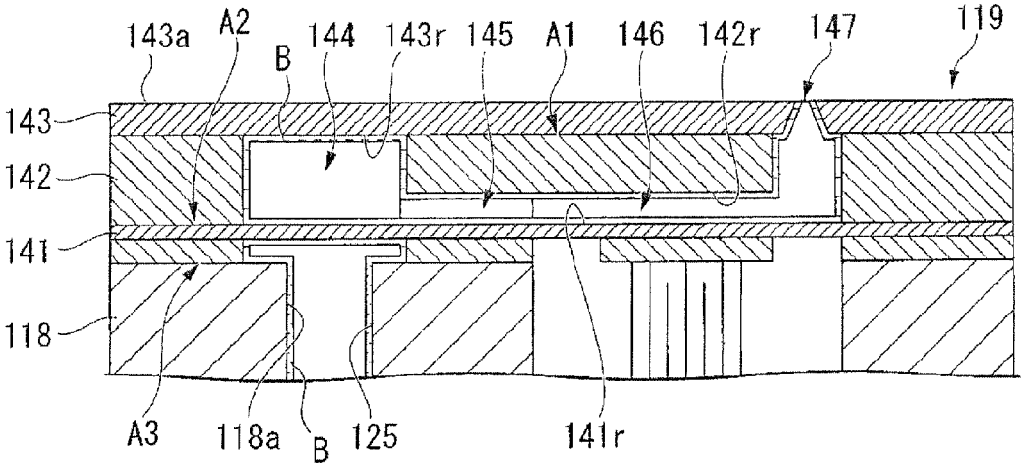
Figure 5C:
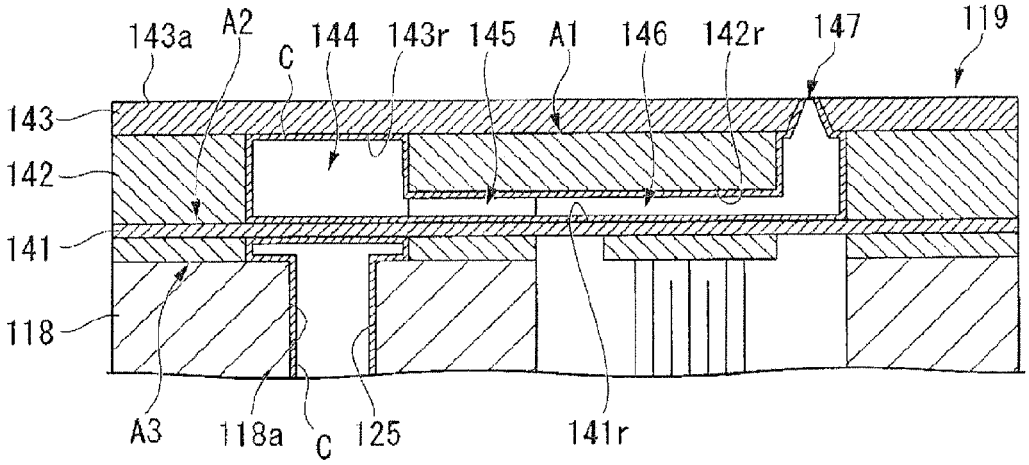

Next, a method for manufacturing the droplet discharge head 34 will be described with reference to FIGS. 5A to 5C. In FIGS. 5A to 5C, a process of manufacturing the liquid-resistant film C will be mainly described and the description of other processes will be omitted as appropriate. Processes other than the process of manufacturing the liquid-resistant film C may be publicly known processes.

First, the nozzle substrate 143, flow path substrate 142, and diaphragm 141 are bonded together in layers using an adhesive. The adhesive may be an epoxy adhesive, an acrylic adhesive, or the like. Next, the head case 118 is bonded to the diaphragm 141 using the adhesive (assembly step).

Next, as shown in FIG. 5A, a material liquid B (material liquid for liquid-resistant film) for the liquid-resistant film C is injected from the case flow path 125 of the head case 118 with the nozzle 147 directed upward so that the case flow path 125 of the head case 118 and the ink flow path R of the flow path unit 119 are filled with the material liquid B (material liquid filling step).

As the material liquid B, a liquid that contains Si and becomes $SiO_x$ after being baked, such as $SiO_2$ sol-gel, Si alkoxide, a silane coupling agent (HMDS), or a silanol compound, is used. The viscosity of the material liquid B is adjusted according to the thickness of the liquid-resistant film C to be formed.

Next, as shown in FIG. 5B, the material liquid B is discharged from the case flow path 125 and ink flow path R. As a result, the material liquid B adheres to the surface 143*r*, 142*r*, and 141*r* of the nozzle substrate 143, flow path substrate 142, and diaphragm 141, respectively, each facing the ink flow path R and the surface 118*a* of the head case 118 facing the case flow path 125 with a predetermined thickness according to the viscosity of the material liquid B. In this state, the material liquid B is heated and then dried (liquid-resistant film forming process).

Thus, as shown in FIG. 5C, the droplet discharge head 34 is manufactured in which the liquid-resistant film C resistant to the ink L is formed continuously on the surfaces 143*r*, 142*r*, and 141*r* facing the ink flow path R and the surface 118*a* facing the case flow path 125.

According to the method for manufacturing the droplet discharge head 34 according to this embodiment, the bonding section A1 between the nozzle substrate 143 and flow path substrate 142 and the bonding section A2 between the flow path substrate 142 and diaphragm 141 are covered with the liquid-resistant film C formed continuously on the surfaces 143*r*, 142*r*, and 141*r*. Therefore, even if the ink flow path R is filled with the ink L when droplets are discharged, the ink L in the ink flow path R is prevented from making contact with the bonding sections A1 and A2. This prevents the ink L in the ink flow path R from penetrating the gaps in the bonding sections A1 and A2 or prevents the ink L from making contact with the adhesive exposed on the portions of the bonding sections A1 and A2 facing the ink flow path R. This prevents the ink L from penetrating the adhesive to cause the adhesive to swell. Thus, the droplet discharge head 34 is improved.

Also, the liquid-resistant film C is formed continuously from the surface 141*r* of the diaphragm 141 facing the ink flow path R to the surface 118*a* of the head case 118 facing the case flow path 125 so that the bonding section A3 between the head case 118 and diaphragm 141 is covered with the liquid-resistant film C. Therefore, even if the case flow path 125 is filled with the ink L when droplets are discharged, the ink L in the case flow path 125 is prevented from making contact with the bonding section A3. This prevents the ink L in the case flow path 125 from penetrating a gap in the bonding section A3 or prevents the ink L from making contact with the adhesive exposed on the portion of the bonding section A3 facing the case flow path 125. This prevents the ink L from penetrating the bonding section A3 to cause the adhesive to swell. Thus, the durability of the droplet discharge head 34 is improved.

Also, the adhesive used in the bonding sections A1, A2, and A3 is isolated from the ink L. Thus, the ink L is prevented from being contaminated due to the solution of the adhesive and the types of the ink L are not limited by the material of the adhesive.

Also, by using a liquid including Si as the material liquid B, the liquid-resistant film C is formed of a lyophilic material such as $SiO_x$. This improves the wettability of the internal portions of the droplet discharge head 34 facing the ink L, as well as arranges the menisci of droplets of the ink L. Thus, droplets of the ink L are discharged with improved performance.

The invention is not limited to the above-described embodiment. For example, a fluoro material liquid, a silicone material liquid, or an organopolysiloxane material liquid containing fluorine may be used in the liquid-resistant film forming step. Thus, a liquid-resistant film formed in the liquid-resistant film forming step becomes a liquid-repellent, liquid-resistant film. By forming the liquid-resistant film using a liquid-repellent material, the characteristic of the liquid-resistant film for isolating the ink from the bonding sections is improved so that the liquid-resistant film is thinned.

The entire disclosure of Japanese Patent Application No. 2007-287011, filed Nov. 5, 2007 is expressly incorporated by reference herein.

What is claimed is:

1. A droplet discharge head, comprising:

a nozzle substrate having a nozzle opening for discharging a liquid as a droplet;

a flow path substrate having a flow path for the liquid, the flow path communicating with the nozzle opening; and a diaphragm constituting a wall surface of the flow path, wherein the nozzle substrate, the flow path substrate, and the diaphragm are bonded together in layers using an adhesive, and a liquid-resistant film resistant to the liquid is continuously formed on surfaces of the nozzle substrate, the flow path substrate, and the diaphragm, the surfaces being in contact with the liquid.

2. The droplet discharge head according to claim 1, further comprising:

a piezoelectric element for changing, via the diaphragm, a volume of a pressure chamber provided in the flow path; and a casing holding the piezoelectric element and having a liquid supply path for supplying the liquid to the flow path, wherein the casing is bonded to the diaphragm using an adhesive, and a surface of the casing facing the liquid supply path is covered with the liquid-resistant film continuously formed from the surface of the diaphragm in contact with the liquid.

3. The droplet discharge head according to claim 1, wherein the liquid-resistant film is formed of a lyophilic material.

4. The droplet discharge head according to claim 1, wherein the liquid-resistant film is formed of a liquid-repellent material.

5. The droplet discharge head according to claim 1, wherein a thickness of the liquid-resistant film is equal to or larger than a thickness of one molecule layer and equal to or less than 1 μm.

6. A droplet discharge apparatus comprising the droplet discharge head according to claim 1.

7. A method for manufacturing a droplet discharge head, comprising:

(a) bonding together a nozzle substrate, a flow path substrate, and a diaphragm using an adhesive, the nozzle substrate having a nozzle opening for discharging a liquid as a droplet, the flow path substrate having a flow path for the liquid, the flow path communicating with the nozzle opening, the diaphragm constituting a wall surface of the flow path,;

(b) filling the flow path with a material liquid for a liquid-resistant film; and (c) discharging the material liquid from the flow path and heating and then drying the material liquid adhering to surfaces of the nozzle substrate, the flow path substrate, and the diaphragm so that a liquid-resistant film resistant to the liquid is continuously formed on the surfaces, the surfaces being in contact with the liquid.

8. The method for manufacturing a droplet discharge head according to claim 7, wherein in step (a), a casing holding a piezoelectric element and having a liquid supply path for supplying the liquid to the flow path is bonded to the diaphragm using an adhesive, the piezoelectric element changing, via the diaphragm, a volume of a pressure chamber provided in the flow path, in step (b), the flow path and the liquid supply path are filled with the material liquid, and in step (c), the material liquid adhering to a surface of the casing is heated and then dried so that the liquid-resistant film continuing from a surface of the diaphragm to a surface of the casing is formed, the surface of the diaphragm facing the flow path, the surface of the casing facing the liquid supply path.

9. The method for manufacturing a droplet discharge head according to claim 7, wherein in step (b), the material liquid is a material liquid containing Si.

10. The method for manufacturing a droplet discharge head according to claim 7, wherein in step (b), the material liquid is any one of a fluoro material liquid, a silicone material liquid, and an organopolysiloxane material liquid containing fluorine.

* * * * *